United States Patent [19]

Jarvis et al.

[11] 4,103,520

[45] Aug. 1, 1978

[54] ADAPTOR FOR AUTOMATED LAUNDRY SYSTEM

[75] Inventors: John R. Jarvis, Dallas; Eldon W. Brown, Garland, both of Tex.

[73] Assignee: Ald, Inc., Dallas, Tex.

[21] Appl. No.: 776,645

[22] Filed: Mar. 11, 1977

[51] Int. Cl.[2] ..... D06F 39/02

[52] U.S. Cl. ..... 68/12 R; 68/17 R; 68/207

[58] Field of Search ..... 68/12 R, 17 R, 207; 134/57 D, 58 D, 95

[56] References Cited

U.S. PATENT DOCUMENTS

| | | | |
|---|---|---|---|
| 3,510,026 | 5/1970 | Wright | 68/17 R X |
| 3,826,113 | 7/1974 | Noraas et al. | 68/17 R X |
| 3,881,328 | 5/1975 | Kleimola et al. | 68/207 X |

*Primary Examiner*—Philip R. Coe

*Attorney, Agent, or Firm*—Fitch, Even, Tabin & Luedeka

[57] ABSTRACT

An automated laundry system is disclosed which includes a washer operative to advance through a plurality of operating cycle stages, an injector having a plurality of liquid additive reservoirs and associated timed control valves operative to selectively inject liquid additives into the washer, and an adaptor connected to the washer and injector for controlling injection of the additives into the washer in predetermined sequence throughout each operating cycle of the washer. The adaptor establishes sequential program signals to the injector for a washer which does not have a built-in programmed signal producing means for the injector.

23 Claims, 3 Drawing Figures

ADAPTOR FOR AUTOMATED LAUNDRY SYSTEM

Figure 1:
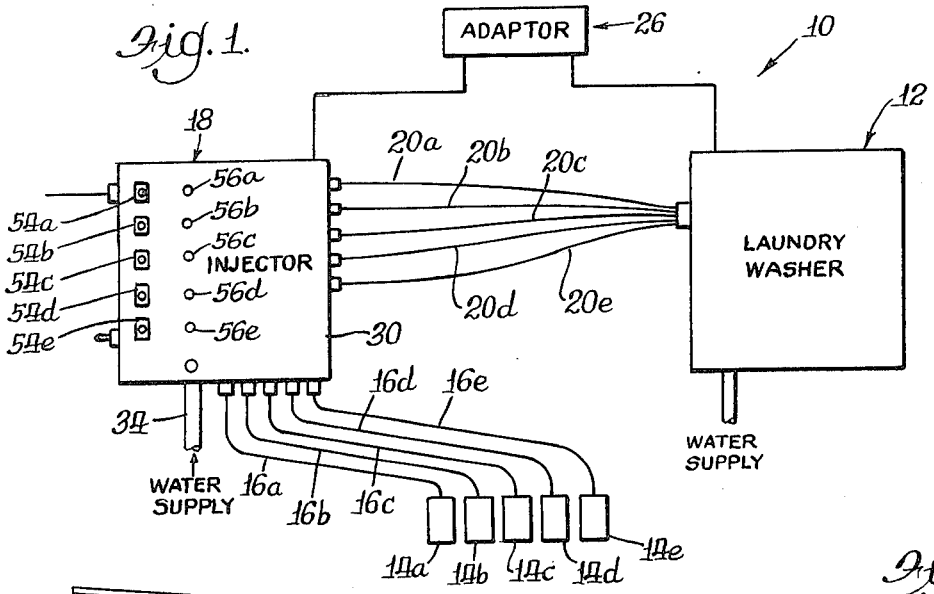

The present invention relates generally to laundry systems, and more particularly to a laundry system which includes a washing machine, injector means for selectively injecting additives into the washer, and a novel adaptor interconnecting the washer and injector and adapted to establish a programmed injection of additives into the washer at selected stages of each washer operating cycle in response to an impulse signal established by the washer during the washer operating cycle.

It is a common practice in laundry operations, and particularly in commercial and industrial laundering, to provide laundry machines in the form of washing machines which are adapted to receive the products to be laundered, generally fabrics, and effect a laundry cycle which includes a plurality of stages during which various functions are carried out in respect to the laundry process. A variety of laundry additives may be injected into the washer during the various stages of a laundry cycle such as, for example, detergents, builders, fabric conditioners and softeners. Particularly in the case of commercial laundry operations, the laundry additive products are generally dispensed or injected into the washing machine from a remote injector feeder which includes reservoirs for the various additives and has timing controls to control the operating time of the injection of the additives into the washing machine. The injection of laundry additives is done in a sequential manner and in measured quantities. The controls for the various laundry additives are generally adapted for response to an electrical signal from the washer so that a particular additive is injected into the washing machine at a predetermined time during the laundry cycle.

A number of commercially available washing machines, and particularly those machines adapted for commercial or industrial use as opposed to private home use, have built-in timing controls which are operative to provide programmed impulse signals to the laundry additive injector to effect sequential timed injection of additives into the washing machine at selected stages of the laundry cycle. There are, however, numerous washing machines which do not have such built-in programmed timing controls to selectively activate a separate laundry additive injector. There thus exists a need for an adaptor for use with the latter described washing machines which can interconnect such a washing machine to a laundry additive injector and which is responsive to an impulse signal produced by the washing machine during its normal operating cycle to effect selective injection of laundry additives into the washing machine. The impulse signal to be supplied by the washing machine may be derived from a liquid fill switch operative to provide a recurring impulse signal during operation of the washer, one or more signal lights which are sequentially energized to indicate the particular stages of a laundry cycle at which the washing machine is operating, or any unused microswitch or contact finger within the washing machine which establishes an impulse signal at selected stages of the laundry cycle. The present invention fulfills this need through the provision of an adaptor which may be operatively connected to a washing machine which does not have a special programmed signal producing means for a remote laundry additive injector, the adaptor in accordance with the invention being adapted to provide sequential signals to a plurality of liquid additive supply sources in response to an impulse signal from the washer so as to effect injection of laundry additives into the washing machine at selected stages of the full operating cycle and for predetermined periods of time.

Accordingly, one of the primary objects of the invention is to provide an adaptor for use in a laundry system to provide interconnection between a washing machine and a laundry additive injector wherein the adaptor facilitates selective injection of laundry additive products into the washer at predetermined stages of a full washer operating cycle.

Another object of the present invention is to provide an adaptor for use in a laundry system employing a laundry additive injector and a washing machine which does not have programmed command impulse signal producing means for the injector built therein, the adaptor in accordance with the present invention being adapted for response to substantially any selected impulse signal produced by the washing machine during predetermined stages of the full operating cycle whereby to provide precision sequential control of additive injection into the washing machine.

A feature of the adaptor in accordance with the present invention lies in the provision of a power supply which is operative to energize control switch means of the adaptor where the adaptor is connected to a washing machine impulse signal producing switch which does not have its own electrical power supply.

A further feature of the adaptor in accordance with the present invention lies in the provision of a multicontact switch operative in response to impulse signals from the washing machine to sequentially control the injection of laundry additives from an injector into the washing machine at predetermined stages of the full operating cycle of the washing machine.

Figure 2:
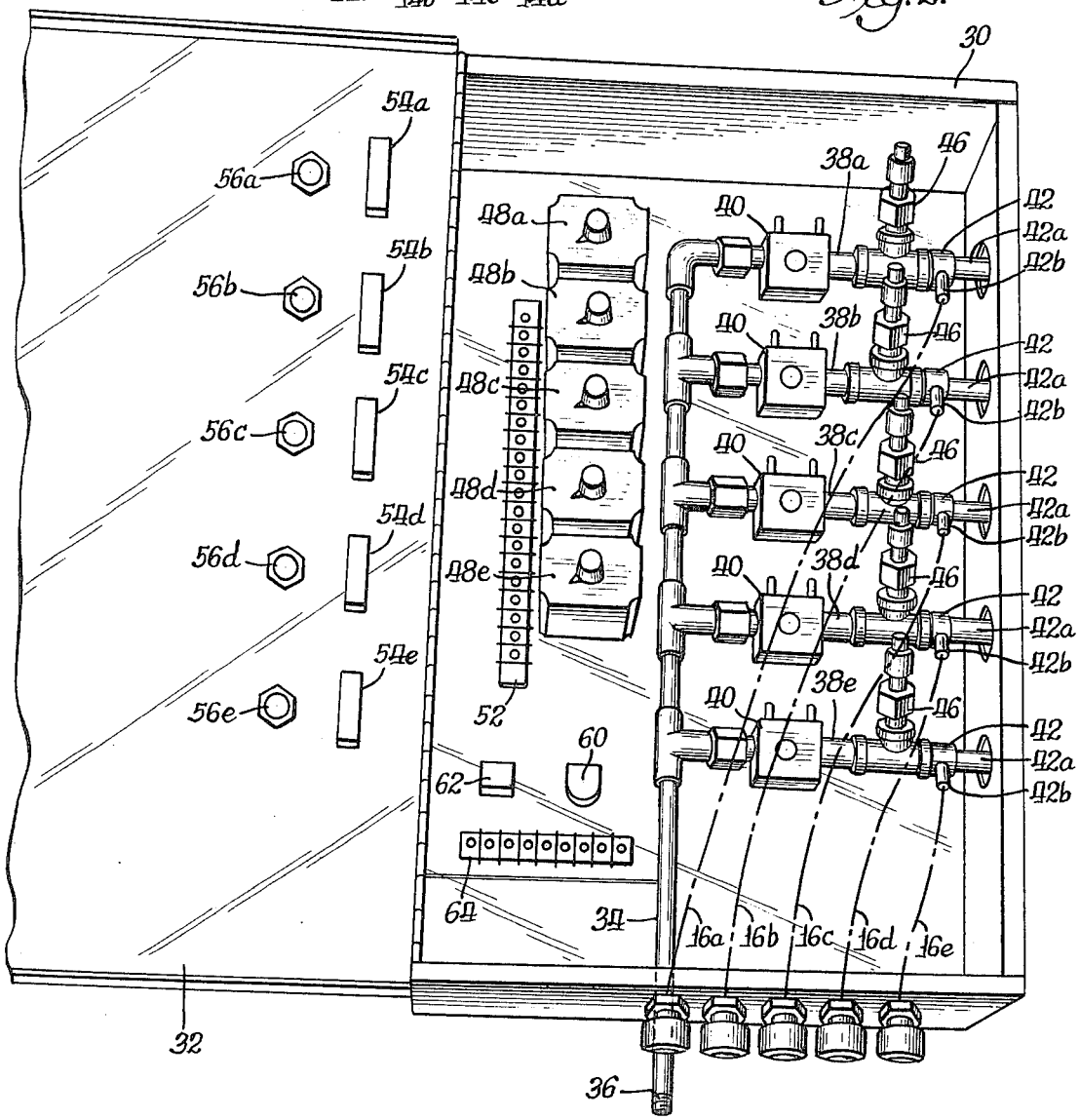
Figure 3:
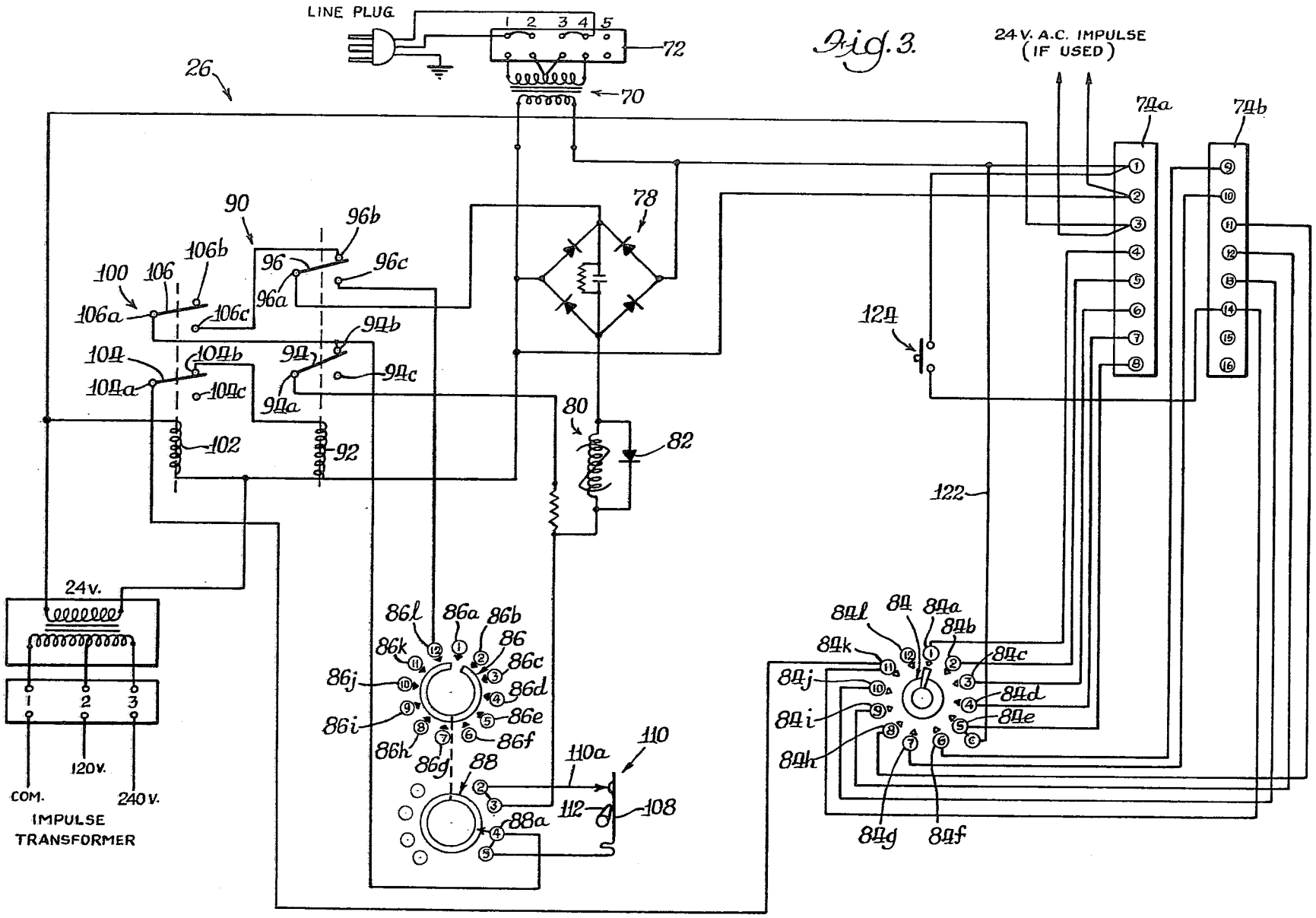

Further objects and advantages of the present invention, together with the organization and manner of operation thereof, will become apparent from the following detailed description of the invention when taken in conjunction with the accompanying drawings wherein like reference numerals designate like elements throughout the several views, and wherein:

FIG. 1 diagramatically illustrates an automated laundry system embodying the present invention;

FIG. 2 is a partial prospective view of the injector control panel shown in FIG. 1 but with the front cover open to show the internal components thereof; and FIG. 3 is a circuit diagram of the adaptor shown diagramatically in FIG. 1.

Referring now to the drawings, and in particular to FIGS. 1 and 2, an automated laundry system employing the present invention is indicated generally at 10. The laundry system 10 includes a laundry washing machine, indicated generally at 12, which may hereinafter be referred to as the "washing machine" or the "washer". The washing machine 12 is of the type adapted to receive a load of laundry, such as fabrics, and subject the laundry to a plurality of laundering stages such as soak, wash, rinse, spin, rerinse, etc., during a full operating cycle of the washer. It is a conventional practice in commercial and industrial laundry systems to introduce chemical laundry additives into the washing machine at selected stages of the complete laundry cycle, the chemical additives generally being in the form of liquid chemical additives although solid or powdered additives may also be employed. Among the more commonly employed chemical additives which are injected into laundry washers are builders, detergents, bleaches, sours and softeners, each being added at a predetermined stage of a complete operating cycle of the washing machine.

In the illustrated laundry system 10, five liquid chemical additive reservoirs are indicated at 14*a–e* and are connected through supply tubes 16*a–e*, respectively, to and form a part of an injector or feeder control, indicated generally at 18. For purposes of illustration, the liquid chemical additive reservoir 14*a* may contain a builder, the reservoir 14*b* may contain a detergent, the reservoir 14*c* may contain a bleach, the reservoir 14*d* may contain a liquid sour, and the reservoir 14*e* may contain a liquid softener. As will become more apparent hereinbelow, the injector control 18 is selectively operable to control injection of the various liquid chemical additives into the washing machine 12 through a plurality of supply tubes 20*a–e* for supplying, respectively, the various liquid chemical additives in the reservoirs 14*a–e* to the washing machine.

Laundry washing machines are commerically available which employ 24 volt control circuits having internal impulse signal programming capability so that impulse signals produced by the internal control circuits can be connected directly to a laundry additive injector and thereby control injection of the various chemical additives at various stages of the laundry cycle. Other types of commerically available laundry washing machines do not have such 24 volt internal impulse signal programming capability so that they cannot be connected directly to a laundry additive injector. It is the latter type of laundry washing machines with which the automated laundry system 10 in accordance with the present invention finds particular application. To this end, the laundry system 10 of the present invention includes adaptor means, indicated generally at 26, which is operatively associated with the washing machine 12 and the injector 18 to control the injection of the various liquid chemical additives from the reservoirs 14*a–e* into the washing machine.

The washing machine 12 is of the type adapted to produce a plurality of impulse signals during a full laundry cycle, such as an impulse signal produced at least once during each stage or during selected stages of the complete laundry cycle. An example of such an impulse signal is the impulse signal produced by a normally open water level switch each time the washer is filled with a washing medium liquid such as water. The impulse signal produced by the water level switch is preferably employed as the impulse signal for the adaptor 26 so that the chemical additives will only be added to the washing system when the washing machine is filled with water. Stated alternatively, the liquid chemical additive should not be injected into the washing machine during any time in the operating cycle when the drain valve of the washing machine is open or when the machine is filling with water. Providing impulse signals to the injector control 18 to inject liquid chemical additives when the washing machine is filled with water is particularly important when the injector is connected to the same water source as the washing machine so as to avoid a pressure drop to the injector which would result in irregular injections of chemical additives into the washing machine. Preferably, the liquid flow pressure to the injector is adjusted at approximately 30 psi.

Referring now to FIG. 2 for a detailed description of the injector control panel 18 and its operation within the laundry system 10 in controlling the injection of liquid chemical additives from the reservoirs 14*a–e* to the washing machine 12, the injector includes a generally rectangular panel casing 30 having a hinged front cover 32. A water supply tube or pipe 34 is supported by the casing 30 and has an outer threaded fitting 36 for attachment to a source of water (not shown) which may be a common water supply source for both the injector and the washing machine 12. The water supply tube 34 is connected to a plurality of injector tubes or pipes which, in the illustrated embodiment, comprise five injector tubes 38*a–e* each of which is adapted to effect injection of one of the liquid chemical additives from the additive reservoirs 14*a–e*. To this end, a solenoid operated control valve 40 of known design is interposed between the water supply pipe 34 and each of the injector tubes 38*a–e* and is operative upon receipt of an electrical energizing signal to control flow of water through the injector tubes 38*a–e*.

An injector 42 is connected in line with each of the injector tubes 38*a–e* and includes a discharge end 42*a* adapted to extend outwardly from the casing 30 for connection to one of the supply tubes 20*a–e*. The injectors 42 are of known design and each includes an intake tube portion 42*b* for connection to one of the liquid chemical additive supply lines 16*a–e*. Water flow through the injectors 42 from the injector tubes 38*a–e* causes a venturi suction action which is operative to draw liquid additives from the associated supply tubes 16*a–e* into the injectors for discharge through the discharge ends 42*a*. A check valve or vacuum breaker valve 46 is connected to each of the water injector tubes 38*a–e* through a tee connection therewith and is of a poppet type valve construction operative to prevent outflow therethrough but facilitating inflow of air each time the flow of water through the associated injector tubes 38*a–e* is terminated so that chemical additives in the supply tubes 20*a–e* will discharge into the washer 12 after the valves 40 are closed. To this end, the rectangular casing 30 is preferably mounted in a vertical upstanding position so that the supply or discharge tubes 20*a–e* run down grade to their respective inlet connections to the washer 12.

The injector panel 30 is also preferably positioned so that the supply tubes 20*a–e* run down grade to the inlet point of the washing machine 12. A liquid level indicating probe may be disposed within each of the chemical additive reservoirs 14*a–e* for providing a signal when the liquid level within the associated reservoir reaches a predetermined low level, whereupon the operator may refill the reservoir. Such low level probes are generally known and are adapted to receive the tubes 16*a–e* downwardly therein, the tubes 16*a–e* preferably extending slightly below the lower ends of the respective low level probes.

To control each of the solenoid operated valves 40, the injector control 18 includes an electrical timer 48*a–e* for each of the solenoid valves 40. The electrical timers 48*a–e* are of known design and each is connected to an associated one of the solenoid valves 40 so as to provide a selected impulse signal to the solenoid valves for maintaining them in open positions for selected periods of time to thereby control the quantity of chemical additives injected into the washing machine 12. Each of the timers 48*a–e* is capable of varying the time during which its output signal is applied to its associated solenoid valve 40. In the illustrated embodiment, the timers 48*a–e* are adjustable to open their associated solenoid valves for periods of between approximately two seconds to two minutes. When the timers 48*a–e* are activated, each will hold its respective solenoid valve open for the preset time whereafter the solenoid valve closes.

As will become more apparent hereinbelow, the injector 18 is preferably operated on a 24 v.a.c. power supply and requires a separate electrical command signal for each of the timers 48*a–e* for controlling liquid chemical additive injection. The timers 48*a–e* are mounted adjacent terminal board 52 in the casing 30 and are selectively connected to terminals thereon. The terminal board 52 provides means for connecting the timers 48*a–e* to the adaptor 26 for transmitting command signals to the timers as will be described more fully hereinbelow. The timers 48*a–e* are also each connected in circuit with a push type control switch 54*a–e*, respectively, mounted on the front panel cover 32 so that manual depression of any one of the control switches 54*a–e* is effective to provide selective energizing of the corresponding one of the solenoid valves 40 for effecting injection of the associated chemical additive to the washer 12. Additionally, suitable indicating lights 56*a–e* are mounted on the panel cover 32 and are connected in a manner so that the lights are energized and provide a visual indication when any one of the timers 48*a–e* is energized for effecting injection of the associated liquid chemical additive into the washing machine 12.

As indicated, the various liquid chemical additive reservoirs 14*a–e* may have liquid level sensing probes (not shown) disposed therein which are operative in a known manner to provide a signal when the levels of liquid within the respective reservoirs reach a predetermined low level. The injector control panel 30 may have a buzzer 60 or other audible signal producing means mounted therein which is connected in circuit with a suitable relay 62 to a terminal block 64 having a plurality of terminals thereon connectible to the level sensing probes within the chemical additive reservoirs 14*a–e*.

As thus far described, it can be seen that providing a command impulse signal to any one of the timers 48*a–e* will effect opening of the associated solenoid valve 40 for a time period as established by the pre-setting of the corresponding timers 48*a–e*. Opening of any one of the solenoid valves 40 effects water flow through the associated injector tube 38*a–e* and draws liquid chemical additive from the associated reservoir 14*a–e* through the associated injector 42 where the water and laundry additive mixture is injected into the washing machine 12. Washing machines capable of producing programmed 24 v.a.c. impulse control signals can be connected directly to the injector control 18 through a suitable wiring harness or the like so as to provide programmed impulse signals to the timers 48*a–e* at predetermined or selected stages during a full operating cycle of the washer. The present invention is directed to means in the form of the adaptor 26 for interconnecting the injector control 18 to a washing machine 12 of the type which does not have internal or built-in means for preprogrammed impulse signals which may be employed to directly control the timers 48*a–e*. The adaptor 26 is adapted for use with washers which provide non-programmed impulse signals at various stages throughout the full operating cycle of the washing machine, such, for example, as the recurring impulse signal produced by a normally open water level switch when the water level within the washer agitating compartment reaches a predetermined level and closes the water level switch at various stages of the full operating cycle. Alternatively, the impulse signal derived from the washer may be provided by one or more signal lights which are sequentially energized to indicate the particular stages of a laundry cycle at which the washing machine is operating, or any unused microswitch or contact finger within the washer which establishes an impulse signal at selected stages of the laundry cycle.

With reference to FIG. 3, a circuit diagram of the adaptor 26 is shown which includes a primary power supply in the form of a primary power transformer, indicated generally at 70, the primary coil of which is connected to a terminal board 72. The terminal board 72 is adapted for connection to 115, 230 or 208 v.a.c. power supplies. In the illustrated circuit, terminal board 72 is wired for connection to a 115 v.a.c. line voltage which requires jumpers between terminals numbered 1 and 2 and between terminals numbered 3 and 4. For use with a 230 volt power supply, a jumper is connected between terminals 2 and 3 and the line voltage is connected to terminals 1 and 4. For connection to a 208 supply voltage, the line voltage is connected to terminals 1 and 5 and a jumper is connected between the terminals 2 and 3.

The primary power transformer 70 is adapted to provide an output of 24 volts at the secondary coil. The positive terminal of the secondary coil of transformer 70 is connected to terminal No. 1 on a terminal board 74*a* while the ground side of the secondary coil of transformer 70 is connected to terminal No. 2 on the terminal board 74*a*. A power bridge in the form of a full wave rectifier bridge 78, having a suitable RC filter, is connected across the output of the secondary of the transformer 70. The power bridge 78 is operative to selectively energize the coil of a stepping motor, indicated schematically at 80, such as is commercially available from Oak Manufacturing Co., Crystal Lake, Ill., as its Model No. 3B, Type 5-53423-611.

The coil of the stepping motor 80 has a suitable arc suppressor diode 82 connected in parallel therewith. The stepping motor 80 has an axial armature shaft (not shown) which is rotatable stepped upon each electrical impulse signal applied to the stepping motor coil, the armature shaft being biased for reverse rotation to return to a home position when the stepping motor coil is deenergized. The adaptor circuit includes first switch means in the form of a multiposition switch having an axial support shaft (not shown) upon which is supported three axially spaced rotatable contacts indicated generally at 84, 86 and 88. The axial support shaft of the multiposition switch is axially aligned with the armature shaft of the stepping motor and is connected thereto through a ratcheting arrangement such that each rotational advance of the stepping motor shaft is operative to step the support shaft of the multiposition switch through an arcuate segment of a full revolution. As will become more apparent below, the multiposition switch includes twelve fixed contacts so that energizing the stepping motor 80 is operative to advance the rotatable contacts 84, 86 and 88 through 30 degrees at each impulse to the stepping motor.

To effect selective energizing of the coil of the stepping motor 80, the adaptor 26 includes second switch means in the form of an impulse relay 100, and third switch means in the form of a stepping motor relay, indicated generally at 90. The stepping motor relay 90 includes a relay coil 92 adapted when energized to effect movement of a pair of contact arms 94 and 96 so as to shift connection of fixed contacts 94*a* and 96*a* from normal connection with contacts 94*b* and 96*b*, respectively, to contact with associated contacts 94*c* and 96*c*. The impulse relay 100 has a relay coil 102 operative when energized to control movement of a pair of relay contact arms 104 and 106 so as to shift connection of fixed contacts 104*a* and 106*a* from normal connection to associated pairs of fixed contacts 104*b*, 106*b*, respectively, to contacts 104*c*, 106*c*. With the power supply 70 "on" and the stepping motor relay coil 92 deenergized, energizing the impulse relay 102 causes the movable contact 106 to connect the output of the power bridge circuit 78 to a normally closed movable contact arm 108 of an interrupter switch 110 so as to energize the stepping motor 80. Energizing the stepping motor 80 effects incremental rotation of the stepping motor armature shaft which is operative to move an actuating lobe, shown schematically at 112, to engage the movable contact arm 108 and move it to an open position relative to a fixed contact 110*a* of the interrupt switch 110 thereby to interrupt energizing of the stepping motor coil. Simultaneously with energizing the stepping motor coil through energizing the impulse relay 102, a holding resistor 114, which is connected in parallel with the interrupter switch 110, is energized through the relay contact arm 106 to electrically lock or hold the stepping motor 80 in its rotationally advanced position until the holding resistor is deenergized.

To control the impulse relay 100 and thus control energizing of the stepping motor 80, the coil 102 of the impulse relay 100 is connected across the secondary coil of an impulse voltage transformer 118 operative to provide a 24 v.a.c. impulse signal to the impulse relay coil 102. To this end, the primary coil of the impulse voltage transformer 118 is adapted for connection to either a 115 or 230 v.a.c. impulse signal supply means in the washing machine 12 such as may be provided by the water level switch or other suitable timer switch or contact finger within the washing machine adapted to provide a recurring impulse signal to the transformer 118 at predetermined time periods or stages throughout the full operating cycle of the washing machine. As seen in FIG. 3, the coil 102 of the impulse relay switch 100 is also connected to terminal Nos. 2 and 3 of the terminal board 74*a*. When the adaptor 26 is used with a washing machine capable of providing recurring 24 v.a.c. impulse signals at predetermined time periods or stages throughout a complete operating cycle, such as from the liquid fill switch, terminals 2 and 3 of terminal board 74*a* are connected directly to the washing machine impulse signal source. Terminal No. 2 on the terminal board 74*a* provides the common or ground connection for the various subcircuits of the adaptor 26. As will become apparent hereinbelow, the impulse relay 100 thus defines second switch means for the adaptor circuit 26, which second switch means is adapted to receive an impulse signal from the washer 12 either directly as by connection through terminals number 2 and 3 on the terminal board 74*a* or indirectly through the impulse voltage transformer 118.

The movable contact 84 operatively associated with the armature shaft of the stepping motor 80 as aforedescribed, is operative to sequentially contact twelve fixed contacts or output terminals 84*a–l* disposed in equidistant circumferentially spaced relation about the axis of the movable contact 84. The movable contact 84 is connected to the secondary coil of the primary transformer 70 through a conductor 122. As shown, the fixed contacts 84*a–k* are each connected to a separate one of the contacts numbered 4–14, respectively, on the terminal boards 74*a* and 74*b*. The contacts 4–14 are selectively connected to the aforementioned terminal boards 52 of the circuit board 50 in the injector 18 as necessary to energize the timers 48*a–e* for the respective laundry additive reservoirs 14*a–e*. In the illustrated embodiment, five laundry additives are controlled by the injector 18 so that only the five command impulse signals are provided to the injector from the adaptor 26 to energize the timers 48*a–e*. In this case, jumpers are connected between selected of the terminals numbered 4–14 on the terminal boards 74*a* and 74*b* as necessary to return the movable contact 84 to its "home" position after laundry additives from reservoirs 14*a–e* have been selectively injected into the washer 12, as will become apparent hereinafter.

As noted, the movable contacts 86 and 88 are rotated simultaneously with the movable contact 84 upon each impulse signal applied to the stepping motor 80. The contact 86 comprises an open annular segment which is adapted to simultaneously contact all but one of twelve fixed contacts 86*a–l* equidistantly circumferentially spaced about the axis of contact 86. Thus, upon incremental rotational movement of contact 86, each fixed contact 86*a–l* is successively open circuited to the contact 86. The contact 86 is in continual electrical connection with the contact 88 which comprises an annular conductor having continual electrical contact with a fixed contact 88*a*.

The fixed contact 86L is connected to the contact 96*c* of the stepping motor relay 92 so as to be connected to the power bridge 78 when the relay coil 92 is energized. When the fixed contact 86L is in closed circuit with the output of power bridge 78, i.e., when relay coil 92 is energized, and the movable contact arm 86 is in a position contacting the fixed contact 86L, a voltage signal is applied to the contact arm 88 and thus to the normally closed interrupter switch arm 108 through fixed contact 88*a* which, in turn, is connected to a fixed contact switch 88*b* connected to the contact arm 108. It is seen that when the stepping motor 80 is deenergized so that the actuating lobe 112 (rotatably actuated by rotation of the shaft of the stepping motor 80) allows contact of the arm 108 with the interrupter switch contact 110*a*, subsequent energizing of the stepping motor relay coil 192 will again energize the contact arm 86 through contact 86L and effect a closed circuit through the stepping motor to continually step the movable contacts 84, 86 and 88 until the opening 87 in contact 86 is opposite contact 86L at which time the circuit to the stepping motor 80 is opened and movement of the contacts 84, 86 and 88 is stopped. The latter positions of the contacts 84, 86 and 88 constitute the "home" position of the adaptor 26.

The adaptor circuit is adapted to automatically return the movable contacts 84 and 86 to their "home" positions after each complete cycle of the washing machine 12 during which controlled amounts of liquid chemical additives are injected into the washing machine from the laundry additive reservoirs 14*a–e*. Homing of the switch contacts 84 and 86 is effected as follows. With the circuit as shown, each impulse signal applied to the impulse relay coil 102 by the impulse voltage transformer 118 or, where the washing machine is capable of directly providing the desired 24 v.a.c. impulse signals, by direct connection of the 24 v.a.c. signals to the relay coil 102 energizes the stepping motor 80 to advance the movable contacts 84 and 86. As the impulse signal advances the stepping motor armature shaft, the actuating lobe 112 opens interrupter switch contact arm 108 after which the holding resistor 114 holds the stepping motor in its advanced position. Simultaneously, advancing the stepping motor advances the contact 84 to the next consecutive fixed contact 84*a–l* whereby to apply a 24 v.a.c. command impulse signal from conductor 122 to the corresponding terminal board connection 74*a, b*. The command signal thus applied to the terminal board 74*a, b* is transmitted to the injector control 18 and to the electrical timer 48*a–e* corresponding to the particular terminal connection on the terminal board 74*a*. As noted, energizing any one of the electrical timers 48*a–e* is operative to open the associated solenoid valve 40 and effect injection of the corresponding liquid chemical additive to the washing machine 12.

The duration of injection of the chemical laundry additives to the washer 12 is established by the setting of the corresponding timers 48*a–e*. Upon termination of each impulse signal supplied to the adaptor 26 from the washing machine, such as when the liquid fill switch is opened during draining of the washer, the voltage applied across the holding resistor 114 is removed thereby allowing the stepping motor 80 to return to its initial position. When the next impulse signal from the washer is applied to the impulse relay coil 102, the stepping motor 80 is again advanced to advance the contact 84 to the next successive fixed contact 84*a–l* and connect that contact to its corresponding terminal on the terminal board 74*a* whereby to again supply a 24 v.a.c. command signal to the corresponding one of the timers 48*a–e*.

When the stepping motor 80 has received sufficient impulse signals from the washer to step the contact 84 to the fixed terminal 84*k*, a 24 v.a.c. impulse signal is applied from transformer 70 through conductor 122 and terminal 84*k* to the relay contact 104*a*. Termination of the impulse signal which caused advance of contact arm 84 to contact 84*k* will deenergize the relay coil 102 and cause the contact arm 104 of the impulse relay switch 102 to energize the stepping relay 92. Energizing the stepping relay coil 92 causes the output from the power bridge 78 to be applied to the terminal 86L and thus to the stepping motor 80 through the closed interrupter switch 110. With the relay coil 92 energized, no voltage is applied to the holding resistor 114 thus allowing the stepping motor 80 to advance until the open portion 87 of the contact 86 is disposed opposite the contact 86L whereupon electrical power to the stepping motor 80 is interrupted preventing further advance of the stepping motor until the impulse relay coil 102 is again energized. As indicated, the latter position of the contact 86 is the "home" position of the switch contacts 84, 86 and 88.

The adaptor 26 includes means for advancing the switch contact 84 to its "home" position without need for impulse signals from the washer to the impulse relay 102 to thus selectively advance the adaptor through its operating sequence. To this end, a normally open homing switch 124 is connected between the secondary coil of the power transformer 70 and terminal 14 on the terminal board 74*b*. Since the terminal 14 on the terminal board 74*b* is connected to the fixed terminal 84*k* of the multiposition switch, and since terminal 84*k* is connected through contact arm 104 to the positive side of the stepping relay coil 92 when the impulse relay 100 is deenergized, closing the homing switch 124 is operative to energize the stepping motor 80 and advance the contact 86 to a position wherein the open portion 87 is opposite contact 86L causing open circuit with the terminal 86*k* and thus deenergizing the stepping motor 80.

It will be appreciated that when using the liquid level switch of a washing machine as the source of a 24 v.a.c. impulse signal to the adaptor 26 or as the impulse signal to the impulse voltage transformer 118, a signal is provided to the adaptor 26 each time the water level in the washer reaches the pre-set level. The adaptor 26 must thus be set for the total number of water fills during a full laundry cycle regardless of the number of laundry additive injections to be made to the washer. If the number of laundry additive injections to be made by the injector 18 is less than the number of water fills during a full cycle of the washer, the terminals numbered 4–14 on the terminal boards 74*a* and 74*b* must be "jumped" as aforedescribed to obtain the desired number and sequence of command signals to the injector 18. It will be appreciated that more than one of the terminals number 4–14 on terminal boards 74*a, b* may be connected to the same timer 48*a–e* of the injector 18 so as to automatically inject the corresponding laundry additive into the washer at different stages of the washer cycle.

Thus, in accordance with the present invention, it will be seen that an automated laundry system is provided which includes an adaptor facilitating connection of an injector control panel to a washing machine so as to inject laundry additives into the washer at predetermined stages of the laundry cycle without need for the washer to have built-in programmed inpulse signal producing means to control the timers in the injector control panel.

While a preferred embodiment of the present invention has been illustrated and described, it will be recognized by those skilled in the art that changes and modifications may be made therein without departing from the invention in its broader aspects. Various features of the invention are defined in the following claims.

What is claimed is:

1. In a laundry system which includes a washer having means operative to effect a cycle of operation during which the washer undergoes a plurality of operating stages, said washer further having means for establishing a recurring impulse signal at predetermined time periods during said cycle of operation, said system including injector means adapted to inject a quantity of at least one laundry additive into said washer in response to a command signal, said injector means including timer means operative to receive said command signal and establish the time duration of each additive injection, the combination therewith comprising adaptor means separate from but operatively associated with said washer and said injector means for controlling the injection of said laundry additives into said washer in direct relation to establishment of said recurring impulse signals, said adaptor means including primary electrical power supply means separate from said power washer, first means connected in circuit to said primary supply means and operable to establish a plurality of command signals in selected sequence, each of said command signals having operative association with said timer means in a manner to control injection of a selected laundry additive into said washer, said adaptor means including second means adapted to receive each impulse signal from said washer and being operative in response to receipt of each impulse signal to actuate said first means to establish a command signal so as to effect injection of a selected laundry additive into said washer.

2. The combination as defined in claim 1 wherein said injector means includes a plurality of reservoirs each of which is adapted to store a laundry additive preliminary to injection of the additives into said washer, said first means comprising a multiposition switch including a plurality of terminal contacts selected ones of which are each connected in circuit to said timer means to control a selected one of said laundry additive reservoirs, said multiposition switch further including a movable contact, and actuator means operative to move said movable contact intermittently through a cycle wherein said movable contact successively contacts said terminal contacts, said second means comprising second switch means operatively associated with said actuator means so as to effect movement of said movable contact to each successive terminal contact upon receipt of each successive impulse signal from said washer.

3. The combination as defined in claim 2 wherein said acutator means comprises a stepping motor having electrical connection with said second switch means and operative in response to an impulse signal applied to said second switch means by said washer to step said movable contact between successive ones of said terminal contacts.

4. The combination as defined in claim 3 wherein said stepping motor includes an armature shaft which is rotationally advanced through a predetermined arcuate angle upon receipt of each impulse signal by said second switch means, said adaptor including means to electrically hold said stepping motor in each rotationally advanced position throughout the duration of the impulse signal which effected the said rotation advance, whereby each command signal established by said first switch means has a time duration substantially equal to the time duration of the corresponding impulse signal applied to said second switch means.

5. The combination as defined in claim 2 wherein said second switch means includes a relay switch responsive to receipt of an impulse signal from said washer to actuate said multiposition switch to establish a different command signal upon receipt of each impulse signal from said washer during a cycle of operation thereof.

6. The combination of claim 2 including third switch means connected in circuit with said primary power supply means and said first and second switch means, said third switch means being operative to advance said multiposition switch to a home position when a voltage signal is applied to said third switch means from said primary power supply and when no impulse signal is applied to said second switch means from said washer.

7. The combination as defined in claim 6 wherein said third switch means includes a relay switch having a relay coil connected in circuit with said second switch means, said third switch means being operative to advance said multiposition switch to said home position when said first switch means initiates a selected one of said command signals and upon termination of the impulse signal to said second switch means which caused establishment of said selected one of said command signals.

8. The combination as defined in claim 2 including a homing switch operatively connected between said primary power supply means and said multiposition switch and operative to sequence said multiposition switch to a selected home position without need of said second switch means receiving an impulse signal from said washer.

9. A laundry system as defined in claim 2 wherein a predetermined position of said movable contact of said multiposition switch constitutes a home position, and wherein said adaptor means includes circuit means adapted to automatically advance said movable contact to said home position after each cycle of operation of said washer.

10. A laundry system as defined in claim 9 wherein said adaptor means includes means to establish said home position of said multiposition switch independently of impulse signals from said washer.

11. An adaptor as defined in claim 2 including a homing switch operatively connected between said primary power supply means and said first switch means and operative to sequence said first switch means to a selected home position without need of said second switch means receiving an impulse signal from the washer.

12. The combination as defined in claim 1 wherein said injector means includes a plurality of reservoirs each of which is adapted to hold a selective liquid additive, an injector operative with each of said reservoirs and adapted to selectively inject the associated additive into said washer, and a control valve associated with each of said injectors operative to control said injectors, said timer means being operatively associated with each of said control valves and responsive to receipt of a command signal from said adaptor to control the duration of injection from each of said reservoirs, said adaptor having electrical connection to said timing means and being operative to transmit said command signals to said timing means in predetermined sequence upon receipt by said adaptor of impulse signals from said washer.

13. A laundry system as defined in claim 1 wherein said primary power supply means provides a 24 v.a.c. output.

14. An adaptor for use in a laundry system which includes a washer having means operative to effect a cycle of operation during which the washer undergoes a plurality of operating stages, said washer further having means for establishing a recurring impulse signal at predetermined time periods during each cycle of operation, and injector means adapted to inject a quantity of at least one laundry additive into said washer in response to a command signal; said adaptor comprising primary electric power supply means separate from said washer, first switch means connected in circuit to said primary power supply means and operable to establish a plurality of command signals in selected sequence, each of said command signals being adapted for operative association with the injector means in a manner to control injection of a selected laundry additive into said washer, said adaptor means including second switch means adapted to receive said recurring impulse signals from the washer and being operative in response to receipt of said impulse signals to actuate said first switch means to establish successive command signals in response to receipt of successive impulse signals from said washer during a cycle of operation of said washer, whereby said adaptor is adapted to control the injection of laundry additives into the washer from the injector means in direct relation to establishment of impulse signals by the washer.

15. An adaptor as defined in claim 14 wherein the injector means of the laundry system includes a plurality of reservoirs each of which is adapted to store a laundry additive preliminary to injection of the additives into the washer, and wherein said first switch means comprises a multiposition switch including a plurality of terminal contacts selected ones of which are adapted for connection in circuit to control selected ones of a plurality of laundry additive reservoirs, said multiposition switch further including a movable contact, and actuator means operative to move said movable contact intermittently through a cycle wherein said movable contact successively contacts said terminal contacts, said second switch means being operatively associated with said actuator means so as to effect movement of said movable contact to each successive terminal contact in response to receipt by said second switch means of successive impulse signals from the washer.

16. An adaptor as defined in claim 15 wherein said actuator means comprises a stepping motor having electrical connection with said second switch means and operative in response to an impulse signal applied to said second switch means from the washer to step said movable contact between successive ones of said terminal contacts.

17. An adaptor as defined in claim 16 wherein said stepping motor includes an armature shaft which is rotationally advanced through a predetermined arcuate angle upon receipt of each impulse signal by said second switch means, said adaptor including means to electrically hold said stepping motor in each rotationally advanced position throughout the duration of the impulse signal which effected the said rotation advance, whereby each command signal established by said first switch means has a time duration substantially equal to the time duration of the corresponding impulse signal applied to said second switch means.

18. An adaptor as defined in claim 15 wherein said second switch means includes a relay switch responsive to receipt by said first switch means of an impulse signal from the washer to establish a different commmand signal upon receipt of each impulse signal during a cycle of operation of the washer.

19. The adaptor of claim 15 including third switch means connected in circuit with said primary power supply means and said first and second switch means, said third switch means being operative to advance said first switch means to a home position when a voltage signal is applied to said third switch means from said primary power supply and when no impulse signal is applied to said second switch means from the washer.

20. An adaptor as defined in claim 19 wherein said third switch means includes a relay switch having a relay coil connected in circuit with said second switch means, said third switch means being operative to advance said first switch means to said home position when said first switch means initiates a selected one of said command signals and upon termination of the impulse signal from the washer to said second switch means which caused establishment of said selected one of said command signals.

21. An adaptor as defined in claim 15 wherein a predetermined position of said movable contact of said multiposition switch constitutes a home position, and wherein said adaptor includes circuit means adapted to automatically advance said movable contact to said home position after each cycle of operation of said washer.

22. An adaptor as defined in claim 21 wherein said adaptor includes means to establish said home position of said multiposition switch independently of receipt by said second switch means of impulse signals from a washer.

23. An adaptor as defined in claim 14 wherein said primary power supply means is adapted to provide a 24 v.a.c. output.

* * * * *

UNITED STATES PATENT AND TRADEMARK OFFICE

CERTIFICATE OF CORRECTION

PATENT NO. : 4,103,520

DATED : August 1, 1978

INVENTOR(S) : John R. Jarvis and Eldon W. Brown

It is certified that error appears in the above-identified patent and that said Letters Patent are hereby corrected as shown below:

Column 10, line 59, Claim 1, "separate from said power" should be --separate from said--

Column 10, lines 60-61, Claim 1, "primary supply" should be --primary power supply--

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*